US009688499B2

(12) United States Patent
Wakide

(10) Patent No.: US 9,688,499 B2
(45) Date of Patent: Jun. 27, 2017

(54) POST-HANDLING APPARATUS AND IMAGE FORMING SYSTEM

(71) Applicant: KONICA MINOLTA, INC., Chiyoda-ku, Tokyo (JP)

(72) Inventor: Hitoshi Wakide, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/836,702

(22) Filed: Aug. 26, 2015

(65) Prior Publication Data

US 2016/0083213 A1 Mar. 24, 2016

(30) Foreign Application Priority Data

Sep. 19, 2014 (JP) ..... 2014-190926

(51) Int. Cl.
*B65H 31/26* (2006.01)
*B65H 43/06* (2006.01)
(Continued)

(52) U.S. Cl.
CPC ..... *B65H 31/26* (2013.01); *B65H 31/02* (2013.01); *B65H 31/3081* (2013.01);
(Continued)

(58) Field of Classification Search
CPC ..... B65H 31/26; B65H 31/34; B65H 31/36; B65H 31/02; B65H 31/10; B65H 31/04;
(Continued)

(56) References Cited

U.S. PATENT DOCUMENTS 5,609,333 A * 3/1997 Mandel ..... B65H 39/11 270/58.09
6,412,774 B1 7/2002 Saito et al.
(Continued)

FOREIGN PATENT DOCUMENTS

JP 2001348155 A 12/2001
JP 2003128339 A 5/2003
(Continued)

OTHER PUBLICATIONS

Chinese Office Action (and English translation thereof) dated Dec. 29, 2016 issued in Chinese counterpart Application No. 201510593422.9.
(Continued)

*Primary Examiner* — Luis A Gonzalez
(74) *Attorney, Agent, or Firm* — Holtz, Holtz & Volek PC

(57) ABSTRACT

A post-handling apparatus having an aligning tray configured to receive a sheet from an image forming apparatus; an ejected sheet tray located adjacent to the aligning tray; a conveyer configured to convey the sheet on the aligning tray to the ejected sheet tray; and a sheet presser configured to press a sheet previously ejected onto the ejected sheet tray against the ejected sheet tray. The sheet presser presses the sheet previously ejected to the ejected sheet tray when a leading edge of a sheet currently conveyed to the ejected sheet tray falls down on the ejected sheet tray, and is in a receding position receding from the ejected sheet tray when a trailing edge of the sheet currently conveyed to the ejected sheet tray falls down on the ejected sheet tray.

20 Claims, 15 Drawing Sheets

(51) Int. Cl.

| | |
|---|---|
| ***B65H 31/34*** | (2006.01) |
| ***B65H 31/02*** | (2006.01) |
| ***B65H 31/30*** | (2006.01) |
| ***B65H 43/02*** | (2006.01) |

(52) U.S. Cl.
CPC ..... *B65H 31/34* (2013.01); *B65H 43/02* (2013.01); *B65H 43/06* (2013.01); *B65H 2301/4212* (2013.01); *B65H 2301/4213* (2013.01); *B65H 2405/11151* (2013.01); *B65H 2801/27* (2013.01)

(58) Field of Classification Search
CPC ..... B65H 31/08; B65H 31/00; B65H 43/06; B65H 43/00; B65H 43/08
See application file for complete search history.

(56) References Cited

U.S. PATENT DOCUMENTS

| | | | | |
|---|---|---|---|---|
| 7,717,421 | B2 * | 5/2010 | Rennick | B65H 31/02 271/207 |
| 7,922,164 | B2 * | 4/2011 | Nakayama | B65H 31/10 270/58.08 |
| 8,511,678 | B2 * | 8/2013 | Azuma | B65H 31/02 271/213 |
| 8,870,175 | B2 * | 10/2014 | Gamo | B65H 39/00 270/58.09 |
| 9,272,872 | B2 * | 3/2016 | Sugiyama | B65H 31/34 |
| 2004/0251608 | A1 * | 12/2004 | Saito | B65H 29/34 271/220 |
| 2007/0063427 | A1 * | 3/2007 | Hong | B65H 31/26 271/220 |

FOREIGN PATENT DOCUMENTS

| | | |
|---|---|---|
| JP | 2007145528 A | 6/2007 |
| JP | 2014166898 A | 9/2014 |

OTHER PUBLICATIONS

Japanese Office Action (and English translation thereof) dated Nov. 15, 2016 issued in counterpart Japanese Application No. 2014-190926.

* cited by examiner

POST-HANDLING APPARATUS AND IMAGE FORMING SYSTEM

This application claims benefit of priority to Japanese Patent Application No. 2014-190926 filed Sep. 19, 2014, the content of which is incorporated herein by reference.

BACKGROUND OF THE INVENTION

1. Field of the Invention

The present invention relates to a post-handling apparatus and an image forming system, and more particularly to a post-handling apparatus configured to handle sheets ejected from an image forming apparatus and an image forming system comprising the post-handling apparatus.

As an example of post-handling apparatuses configured to handle sheets ejected from an image forming apparatus, a post-handling apparatus disclosed in Japanese Patent Laid-Open Publication No. 2007-145528 is well known. Such a conventional post-handling apparatus handles sheets ejected from an image forming apparatus and ejects the sheets to an ejected sheet tray of the post-handling apparatus. The ejected sheet tray conventionally has a mechanism to move up and down the ejected sheet tray depending on the load on the ejected sheet tray.

Meanwhile, it is suggested that the mechanism to move up and down the ejected sheet tray depending on the load on the ejected sheet tray be omitted from the ejected sheet tray in order to downsize the post-handling apparatus. However, omitting the mechanism from the ejected sheet tray may cause a problem that when a sheet is newly ejected onto the ejected sheet tray, sheets previously ejected onto the ejected sheet tray fall therefrom due to impact with the sheet newly coming to the ejected sheet tray.

SUMMARY OF THE INVENTION

An object of the present invention is to provide a post-handling apparatus that prevents sheets previously ejected onto an ejected sheet tray from falling therefrom due to impact with a sheet newly coming to the ejected sheet tray, and an image forming system comprising the post-handling apparatus.

According to a first aspect of the present invention relates to a post-handling apparatus for handling sheets ejected from an image forming apparatus, and the post-handling apparatus comprises: an aligning tray configured to receive a sheet from the image forming apparatus; an ejected sheet tray located adjacent to the aligning tray; a conveyer configured to convey the sheet on the aligning tray to the ejected sheet tray in a sheet ejecting direction; and a sheet presser configured to press a sheet previously ejected onto the ejected sheet tray against the ejected sheet tray, wherein the sheet presser presses the sheet previously ejected onto the ejected sheet tray when a leading edge, with respect to the sheet ejecting direction, of a sheet currently conveyed to the ejected sheet tray falls down on the ejected sheet tray, and is in a receding position receding from the ejected sheet tray when a trailing edge, with respect to the sheet ejecting direction, of the sheet currently conveyed to the ejected sheet tray falls down on the ejected sheet tray.

According to a second aspect of the present invention relates to an image forming system, and the image forming system comprises: the post-handling apparatus described above; and an image forming apparatus.

DETAILED DESCRIPTION OF THE PREFERRED EMBODIMENTS

Figure 1:
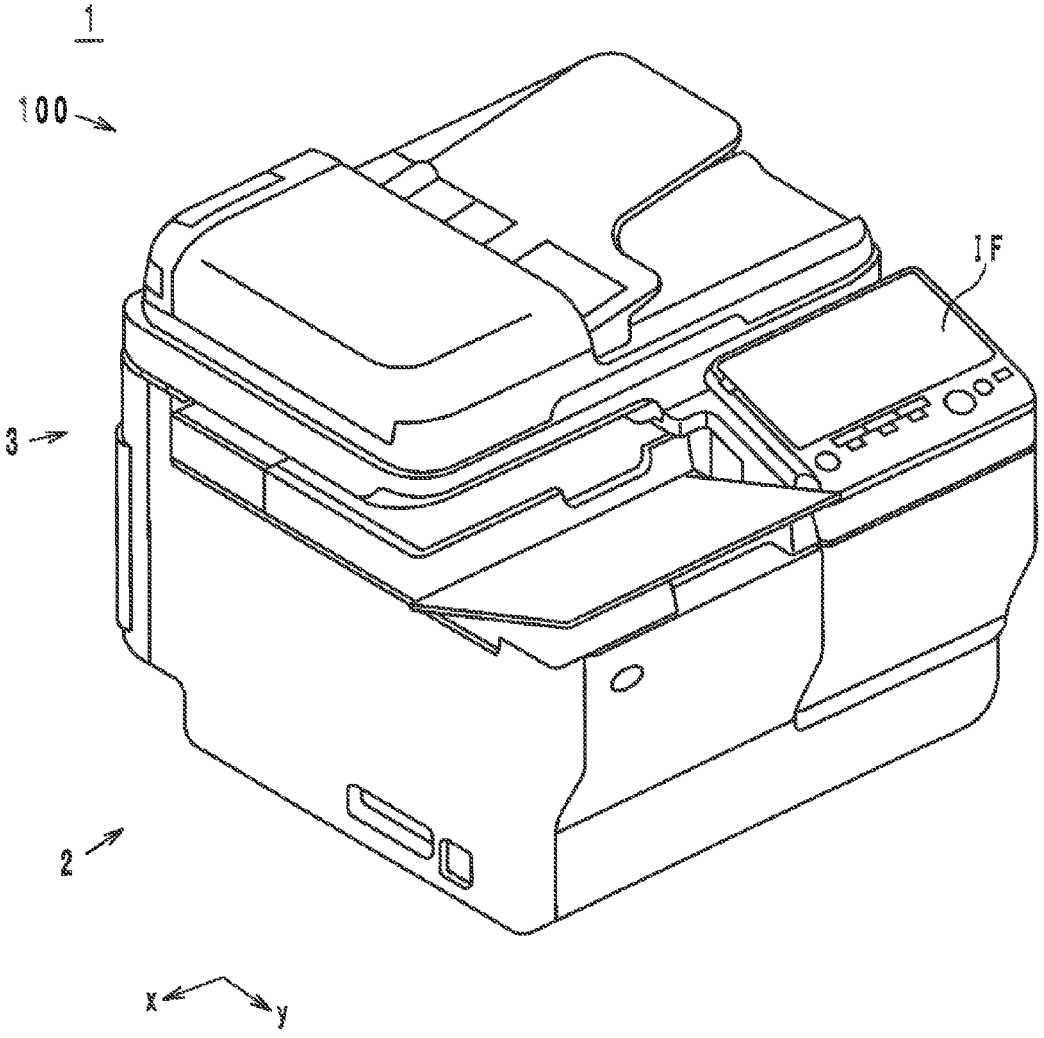
FIG. 1 is a perspective view of an image forming system according to an embodiment of the present invention.

General Structure of Image Forming System and Post-Handling Apparatus; See FIGS. 1-3

An image forming system 1 and a post-handling apparatus 3 according to an embodiment of the present invention are hereinafter described with reference to the drawings. In the following description, the direction in which an image forming apparatus 2 ejects a sheet is referred to as a positive side in x-direction or a positive x-direction, and a direction opposite thereto is referred to as a negative side in x-direction or a negative x-direction. The direction in which a rear-side aligning plate 29 pushes a sheet or a stack of sheets P to an ejected sheet tray 35 is referred to as a positive side in y-direction or a positive y-direction, and a direction opposite thereto is referred to as a negative side in y-direction or a negative y-direction. In this embodiment, the y-direction is orthogonal to the x-direction and the vertical direction.

Figure 2:
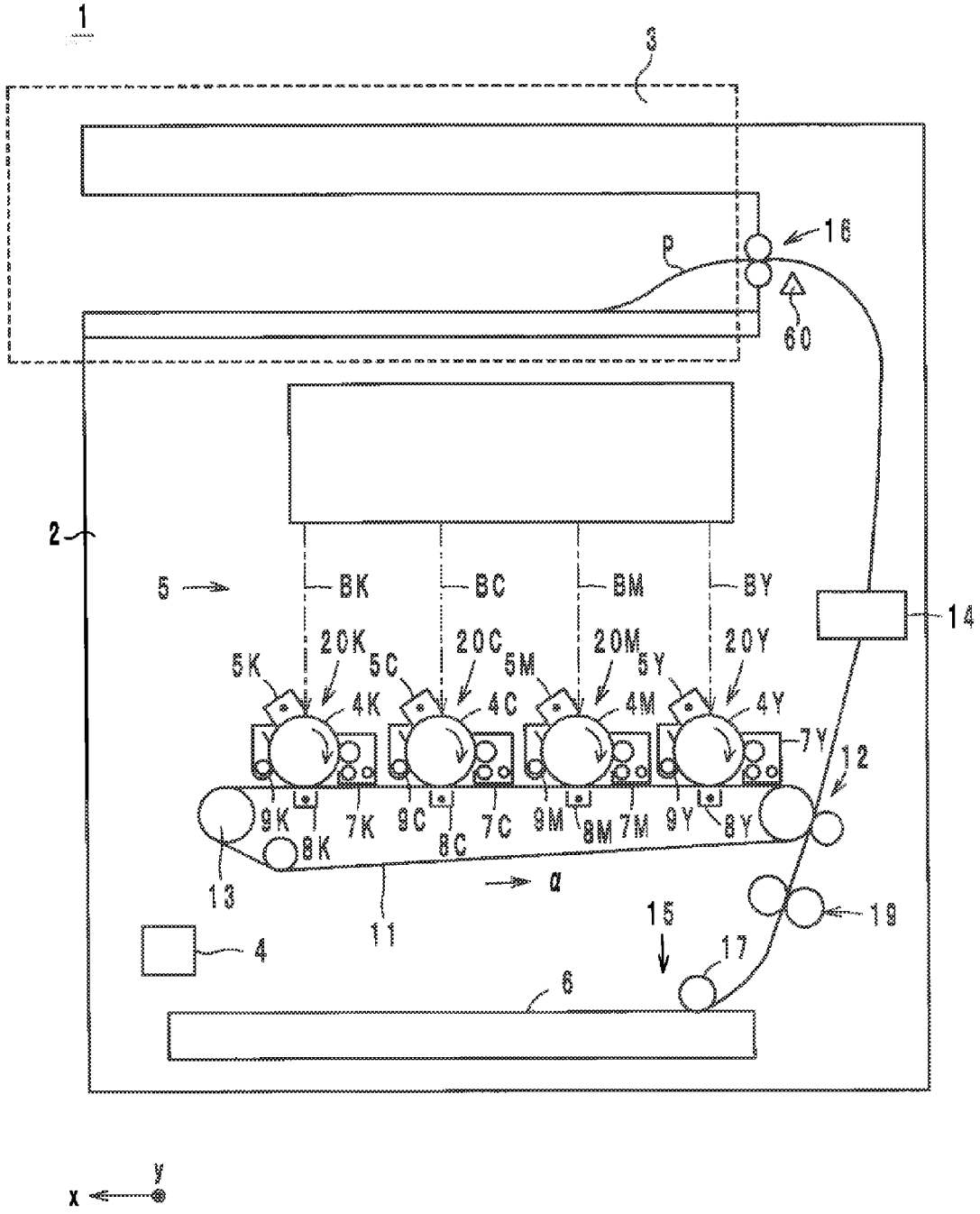
FIG. 2 is a schematic view of the internal structure of a post-handling apparatus and an image forming apparatus of the image forming system.

As illustrated in FIG. 1, the image forming system 1 comprises an image forming apparatus 2, a post-handling apparatus 3 and an image reading apparatus 100. The image forming system 1 further comprises a control unit 4 inside the image forming apparatus 2 as illustrated in FIG. 2, and the control unit 4 controls the image forming apparatus 2, the post-handling apparatus 3 and the image reading apparatus 100.

The image forming apparatus 2 comprises an imaging unit 5 configured to form toner images by a conventional electrophotographic process. Sheets P are fed from a sheet feeder section one by one, and the toner images are transferred to the sheets P at a transfer section 12 one by one. The imaging unit 5 may be configured to form a full-color toner image or to form a monochromatic toner image. Further, if the imaging unit 5 is configured to form a full-color toner image, the imaging unit 5 may be a tandem type or a four-cycle type. The sheets P that received toner images at the transfer section 12 undergo a heating treatment at a fixing unit 14 for fixation of toner thereon, and the sheets P are ejected from the image forming apparatus 2 one by one through a pair of ejection rollers 16. The ejection of each sheet from the image forming apparatus 2 is detected by a sheet ejection sensor 60 located near an exit of the image forming apparatus 2.

Figure 3:
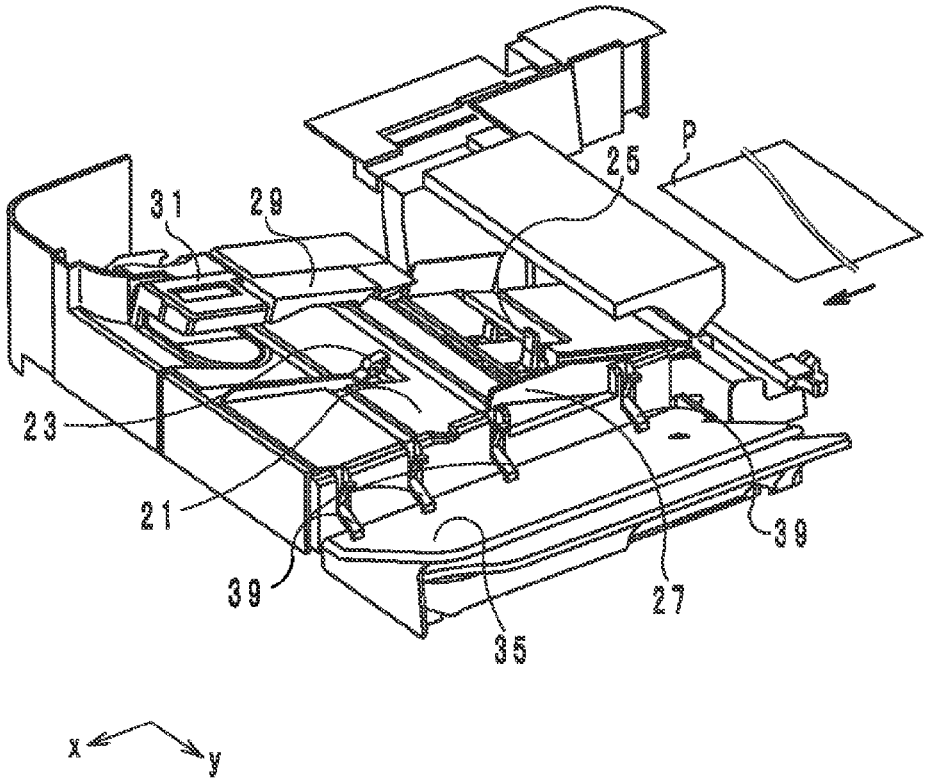
FIG. 3 is a perspective view of the post-handling apparatus.

The post-handling apparatus 3 is an apparatus configured to handle, for example, align and/or staple the sheets P ejected from the image forming apparatus 2. As illustrated in FIG. 3, the post-handling apparatus 3 comprises an aligning tray 21, a leading-edge support member 23, a trailing-edge support member 25, a front-side aligning plate 27, a rear-side aligning plate 29, a stapler 31, and an ejected sheet tray 35. The ejected sheet tray 35 is located adjacent to the aligning tray 21 and more specifically at the positive side in y-direction of the aligning tray 21.

A basic process carried out by the post-handling apparatus 3 is described below. Each printed sheet P ejected from the exit of the image forming apparatus is received on the aligning tray 21 and is conveyed to a predetermined position on the aligning tray 21 while being aligned by use of the leading-edge support member 23, the trailing-edge support member 25, the front-side aligning plate 27 and the rear-side aligning plate 29. The aligned stack of sheets P is stapled by a stapler 31 as needed. The sheet P or the stack of sheets P conveyed to the predetermined position on the aligning tray 21 is pushed out to the ejected sheet tray 35 by the rear-side aligning plate 29. This is a basic process carried out by the post-handling apparatus 3.

Detailed Structure Around Ejected Sheet Tray; See FIGS. 4-6

Figure 4:
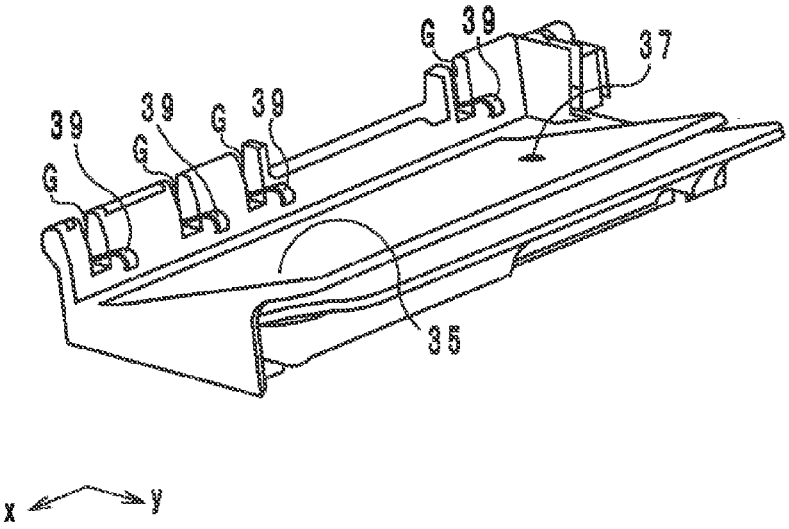
FIG. 4 is a perspective view of a portion around an ejected sheet tray.
Figure 5:
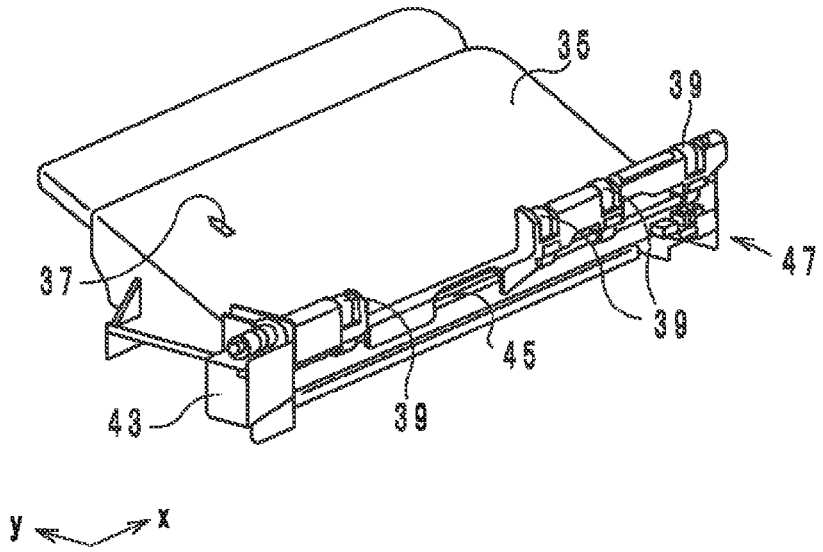
FIG. 5 is a perspective view of the portion around the ejected sheet tray.

As illustrated in FIG. 4, the post-handling apparatus 3 further comprises a sheet ejection sensor 37 configured to detect a sheet or a stack of sheets ejected onto the ejected sheet tray 35, and sheet pressers 39 configured to hold the ejected sheet or the ejected stack of sheets on the ejected sheet tray 35. As illustrated in FIG. 5, the post-handling apparatus 3 still further comprises a motor 43 serving as a drive source of the sheet pressers 39, a shaft 45 configured to transmit the drive force from the motor 43 to the sheet pressers 39, and a monitoring system 47 configured to monitor the rotation of the shaft 45.

The sheet ejection sensor 37 is fitted in a dent made in the upper surface of the ejected sheet tray 35. When a sheet P or a stack of sheets P ejected from the aligning tray 21 covers the upper surface of the ejected sheet tray 35, the sheet ejection sensor 37 detects a sheet on the ejected sheet tray 35. Then, the sheet ejection sensor 37 sends a signal indicating the state to the control unit 4.

The sheet pressers 39 are to prevent one or more sheets P previously ejected onto the ejected sheet tray 35 from falling from the ejected sheet tray 35 due to collision with one or more sheets P newly ejected thereto. The sheet pressers 39 are also to prevent the sheets P already ejected onto the ejected sheet tray 35 from curling, thereby preventing the sheets P from increasing in volume on the ejected sheet tray 35. As seen in FIG. 4, each of the sheet pressers 39 is substantially J-shaped when viewed from the x-direction. Respective one ends of the sheet pressers 39 are fixed to the shaft 45 such that the sheet pressers 39 are capable of rotating along with the shaft 45. With the rotation of the sheet pressers 39, the respective other ends of the sheet pressers 39 hit and press the upper surface of the sheet or the stack of sheets P on the ejected sheet tray 35. In this embodiment, a total of four sheet pressers 39 are fixed to the shaft 45.

The motor 43 is a drive source of the rotation of the sheet pressers 39. The motor 43 is activated at appropriate times under control of the control circuit 4. As illustrated in FIG. 5, the motor 43 is located around a corner of the ejected sheet tray 35 at the negative end in x-direction and the negative end in y-direction. The motor 43 is enclosed in sheet metal.

The shaft 45 is a round bar extending in the x-direction and is located at the negative end in y-direction of the sheet ejected tray 35. As described above, the sheet pressers 39 are fixed to the shaft 45. A first end of the shaft 45 is connected to the motor 43 via a gear. Accordingly, the shaft 45 transmits the force supplied from the motor 43 to the sheet pressers 39. Additionally, near a second end of the shaft 45, a closure plate 47*a*, which is a component of the monitoring system 47, is provided.

Figure 6:
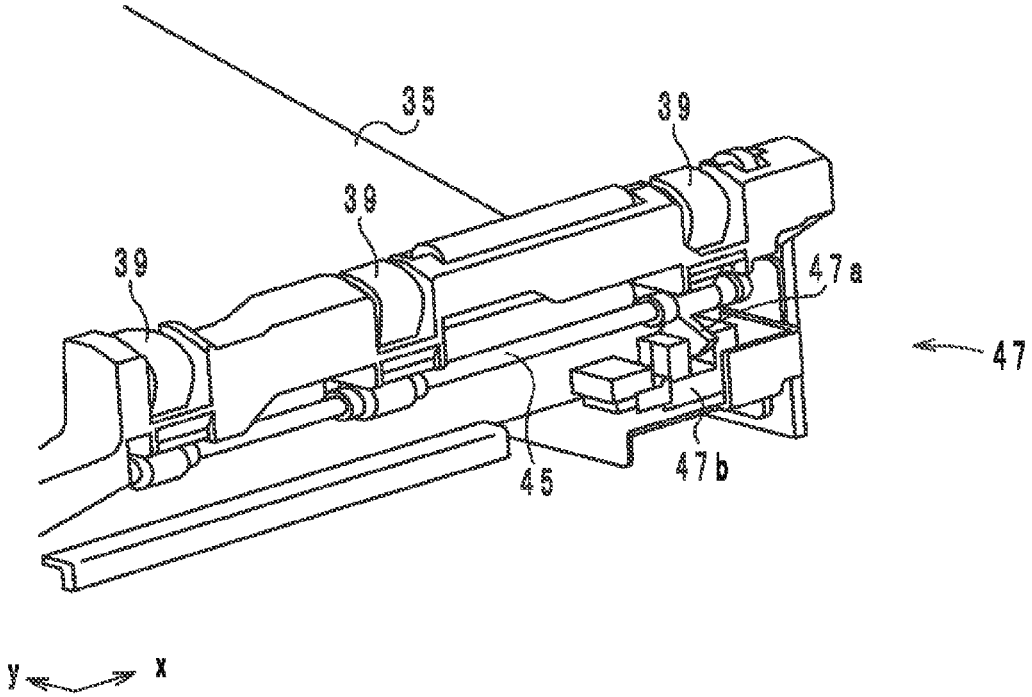
FIG. 6 is a perspective view of a portion around a monitoring system.

The monitoring system 47, as illustrated in FIG. 6, comprises the closure plate 47*a* and a shaft sensor 47*b*. As mentioned above, the closure plate 47*a* is fixed to a portion of the shaft 45 near the second end. The closure plate 47*a* is a sector plate, and its main surfaces in a sector form are perpendicular to the x-direction. The shaft sensor 47*b* is an optical sensor having a light emitting element and a light receiving element. The shaft sensor 47*b* is shaped like a right-angled U having an open upper side when viewed from the y-direction. In the monitoring system 47 having this structure, the closure plate 47*a* cuts across the open side of the right-angled U shape of the shaft sensor 47*b* as the shaft 45 rotates. In this moment, the closure plate 47*a* blocks light coming from the light emitting element of the shaft sensor 47*b*. In this way, the monitoring system 47 monitors the rotation of the shaft 45.

Sheet Ejection from Post-Handling Apparatus

Sheet ejection from the post-handling apparatus 3 is described below. In the following description, a sheet which has not been ejected completely onto the ejected sheet tray 35 is referred to as a sheet P1, and a sheet which has been ejected completely onto the ejected sheet tray 35 is referred to as a sheet P2. In the following, a case where a sheet P1 is ejected from the aligning tray 21 to the ejected sheet tray is considered.

Figure 7:
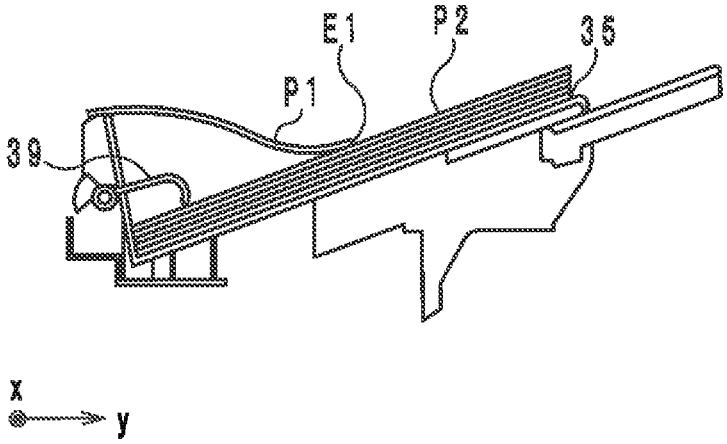
FIG. 7 is a sectional view illustrating a moment when the leading portion of a sheet coming to the ejected sheet tray falls in the ejected sheet tray.

A sheet P1 ejected from the image forming apparatus 2 is received on the aligning tray 21 and then ejected therefrom to the ejected sheet tray 35 by the rear-side aligning plate 29. In this moment, if there are any sheets P2 on the ejected sheet tray 35, as illustrated in FIG. 7, the sheet pressers 39 press the upper surface of the stack of sheets P2. However, while the sheet P1 is coming from the aligning tray 21 to the ejected sheet tray 35, the sheet pressers 39 move back in a receding position. The following description is focused on this point.

Figure 8:
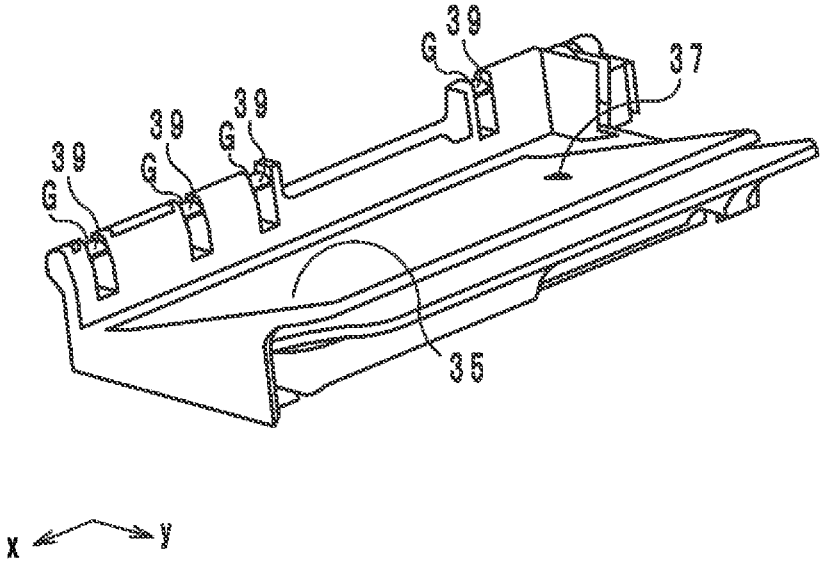
FIG. 8 is a perspective view of the portion around the ejected sheet tray in a state where sheet pressers are in a receding position.

Initially, as illustrated in FIG. 8, before a sheet P1 is ejected from the image forming apparatus 2 to the aligning tray 21, the sheet pressers 39 are hidden in holes G formed at the negative side in y-direction of the ejected sheet tray 35, that is, are located in the receding position. When the sheet ejection sensor 37 detects a sheet or a stack of sheets P2 on the ejected sheet tray 35, a signal is sent to the control unit 4. Thereafter, at a time when the sheet P1 is ejected from the image forming apparatus 2 to the aligning sheet 21, the motor 43 is activated. Thereby, the sheet pressers 39 rotate along with the shaft 45 and come out of the holes G. Then, as illustrated in FIG. 7, the sheet pressers 39 press the upper surface of the sheet or the stack of sheets P2 on the ejected sheet tray 35. Accordingly, when the leading edge E1 of the sheet P1 falls down on the sheet or the stack of sheets P2 on the ejected sheet tray 35, the sheet or the stack of sheets P2 is already pressed by the sheet pressers 39. Therefore, the sheet P1 passes over the sheet pressers 39 and falls down on the sheet or the stack of sheets P2.

Figure 9:
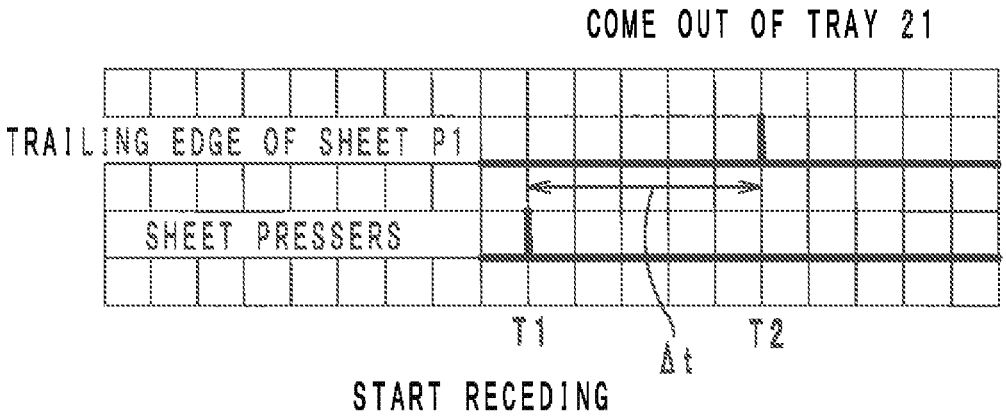
FIG. 9 is a timing chart indicating the relation between a point of time when the trailing edge of a sheet being ejected from an aligning tray to the ejected sheet tray comes out of the aligning tray and a point of time when a movement of the sheet pressers to the receding position is started.
Figure 10:
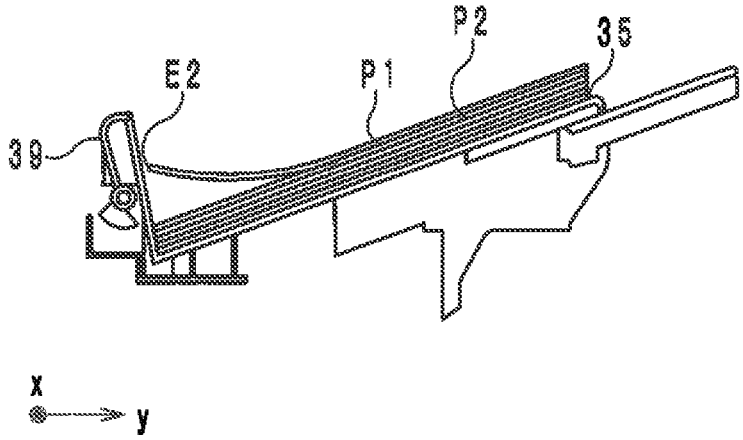
FIG. 10 is a sectional view illustrating a moment when the trailing edge of a sheet coming to the ejected sheet tray falls in the ejected sheet tray.

While the sheet P1 is passing over the sheet pressers 39, the sheet pressers 39 start receding into the holes G. As illustrated in FIG. 9, a point of time T1 when the sheet pressers 39 start the receding movement is Δt earlier than a reference time T2, wherein Δt is a period of time required for a movement of the sheet pressers 39 from the ejected sheet tray 35 into the holes G, and T2 is a point of time when the trailing edge of the sheet P1 comes out of the aligning tray 21. Accordingly, as illustrated in FIG. 10, when the trailing edge E2 of the sheet P1 comes out of the aligning tray 21, the receding movement of the sheet pressers 39 has been already completed. The point of time T2 when the trailing edge E2 of the sheet P1 comes out of the aligning tray 21 is approximated from a point of time when the rear-side aligning plate 29 reaches the positive end in y-direction of the aligning tray 21. The period of time Δt required for a movement of the sheet pressers 39 from the ejected sheet tray 35 into the holes G is determined from a value preliminarily stored in the control unit 4.

After completion of the ejection of the sheet P1, the sheet pressers 39 start coming to a position again to press the upper surface of the stack of sheets P2 on the ejected sheet tray 35. In this regard, the control unit 4 perceives the travel distance (rotation angle) of the sheet pressers 39 from information sent from the monitoring system 47. If the travel distance is smaller than a predetermined value, the control unit 4 determines that sheets have been stacked on the ejected sheet tray 35 up to the limit of loading capacity of the ejected sheet tray 35.

When the control unit 4 determines that sheets have been stacked on the ejected sheet tray 35 up to the limit of loading capacity of the ejected sheet tray 35, the control unit 4 stops the image forming apparatus 2 from starting a next image forming process. Also, an interface IF provided on the image forming apparatus 2 displays information that sheets have been stacked on the ejected sheet tray 35 up to the limit of loadable capacity, that is, information that the ejected sheet tray 35 is full. Further, the control unit 4 keeps the sheet pressers 39 pressing the upper surface of the stack of sheets P2. In other words, the control unit 4 prohibits the sheet pressers 39 from receding.

However, if there is a sheet P1 remaining on the aligning tray 21, the control unit 4 permits ejection of the sheet P1 from the aligning sheet tray 21 in order to complete the ejection of the sheet P1 from the post-handling apparatus 3. In this regard, when the leading edge E1 of the sheet P1 comes out of the aligning tray 21 to the ejected sheet tray 35, the sheet pressers 39 press the upper surface of the stack of sheets P2 on the ejected sheet tray 35. While the sheet P1 is being ejected from the aligning tray 21 to the ejected sheet tray 35, the sheet pressers 39 move to the receding position. Thus, if there is a sheet P1 remaining on the aligning tray 21, the control unit 4 once cancels the prohibition of the receding movement of the pressers 39. Then, after completion of the ejection of the sheet P1 from the post-handling apparatus 3, the sheet pressers 39 come to a position again to press the upper surface of the stack of sheets P2 on the ejected sheet tray 35.

Thereafter, when the user discharges the stack of sheets P2 from the ejected sheet tray 35, the control unit 4 receives information from the sheet ejection sensor 37 that there are no sheets on the ejected sheet tray 35. In response, the control unit 4 permits the image forming apparatus 2 to start a next image forming process and returns the display screen on the interface IF to a normal screen. Further, the control unit 4 returns the sheet pressers 39 to the receding position.

Incidentally, if a receding movement of the sheet pressers 39 from the ejected sheet tray 35 by order of the control unit 4 is not completed within a predetermined period of time, the control unit 4 takes a process depending on whether there is a sheet on the ejected sheet tray 35.

Figure 11:
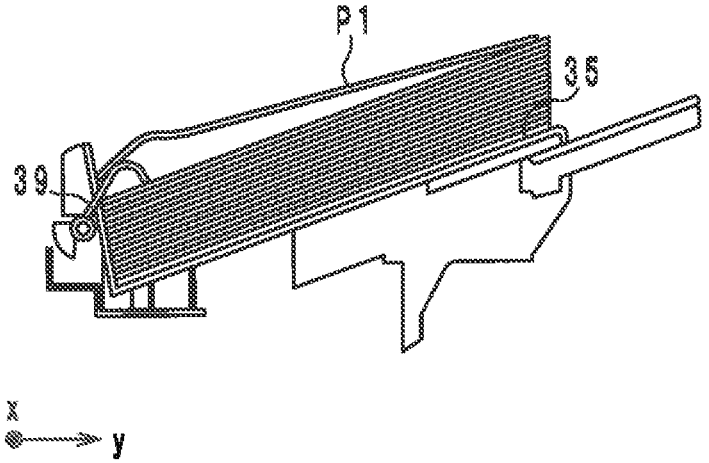
FIG. 11 is a sectional view illustrating a state where a sheet is stuck between the sheet pressers and the exit of the post-handling apparatus.
Figure 12:
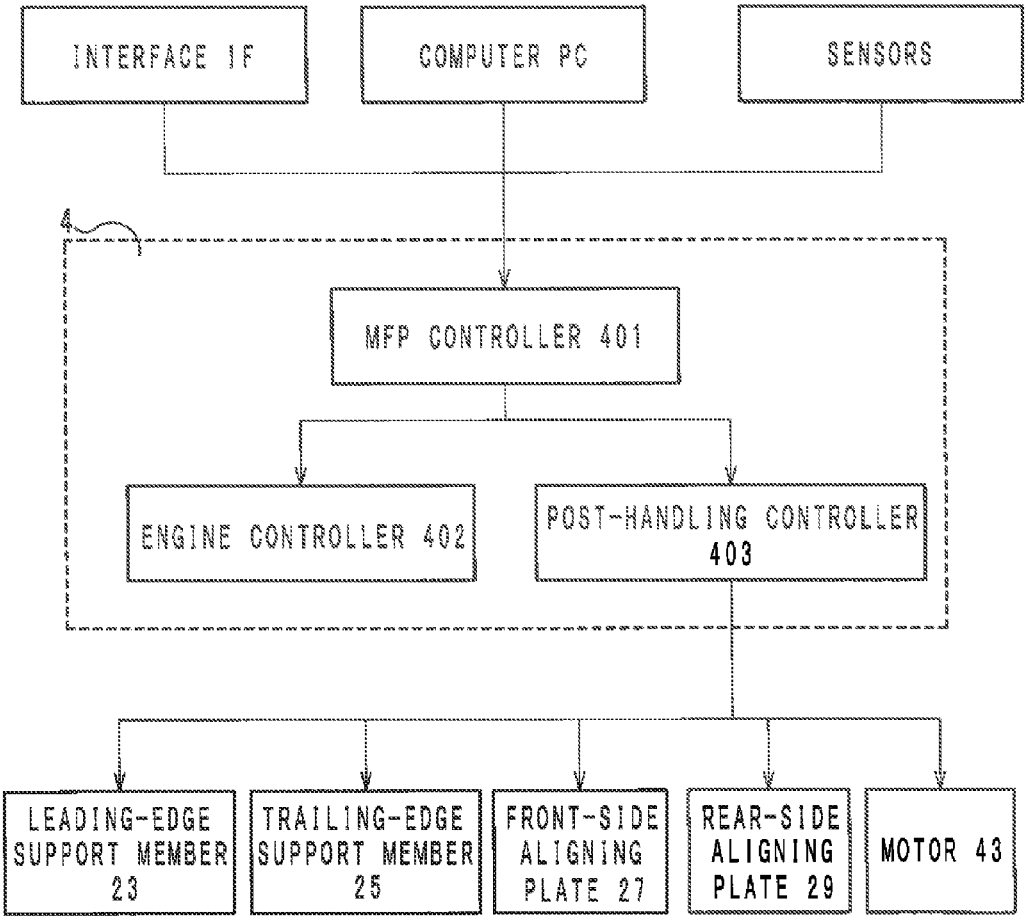
FIG. 12 is a block diagram indicating the relation among components relating to sheet ejection, the control unit, the image forming apparatus and sensors.

If a receding movement of the sheet pressers 39 from the ejected sheet tray 35 by order of the control unit 4 is not completed within a predetermined period of time and if there is a sheet on the ejected sheet tray 35, the control unit 4 takes a process similar to the process the control unit 4 carries out when the control unit 4 has determined that sheets have been stacked on the ejected sheet tray 35 up to the limit of loading capacity. Specifically, the control unit 4 stops the image forming apparatus 2 from starting a next image forming process and drives the interface IF to display information that sheets have been stacked on the ejected sheet tray 35 up to the limit of loading capacity. This permits a user to perceive the problem, for example, that a sheet P1 is stuck between the sheet pressers 39 in the middle of a receding movement and the exit of the post-handling apparatus 3 as illustrated in FIG. 11, and the user can remove the sheet P1.

If a receding movement of the sheet pressers 39 from the ejected sheet tray 35 by order of the control unit 4 is not completed within a predetermined period of time and if there are no sheets on the ejected sheet tray 35, the control unit 4 determines that any component relating to the sheet pressers 39 has a defect. Then, the control unit 4 stops the image forming apparatus 2 from staring a next image forming process and drives the interface IF to display information that any component relating the sheet pressers 39 has a defect.

Control of Sheet Ejection

In a procedure of controlling sheet ejection, first, an MFP controller 401 of the control unit 4 obtains information from the user interface IF provided on the image forming apparatus 2, a computer terminal PC, and the sensors provided in the image forming apparatus 2 and the post-handling apparatus 3. In accordance with the information, an engine controller 402 of the control unit 4 controls image formation in the image forming apparatus 2 and ejection of a printed sheet P from the image forming apparatus 2. A post-handling controller 403 of the control unit 4 activates the motor 43 for the support members, the aligning plates and the pressers 39, and other members to carry out sheet ejection. In the following, a control flow is described with reference to FIGS. 13 through 19.

Main Routine

Figure 13:
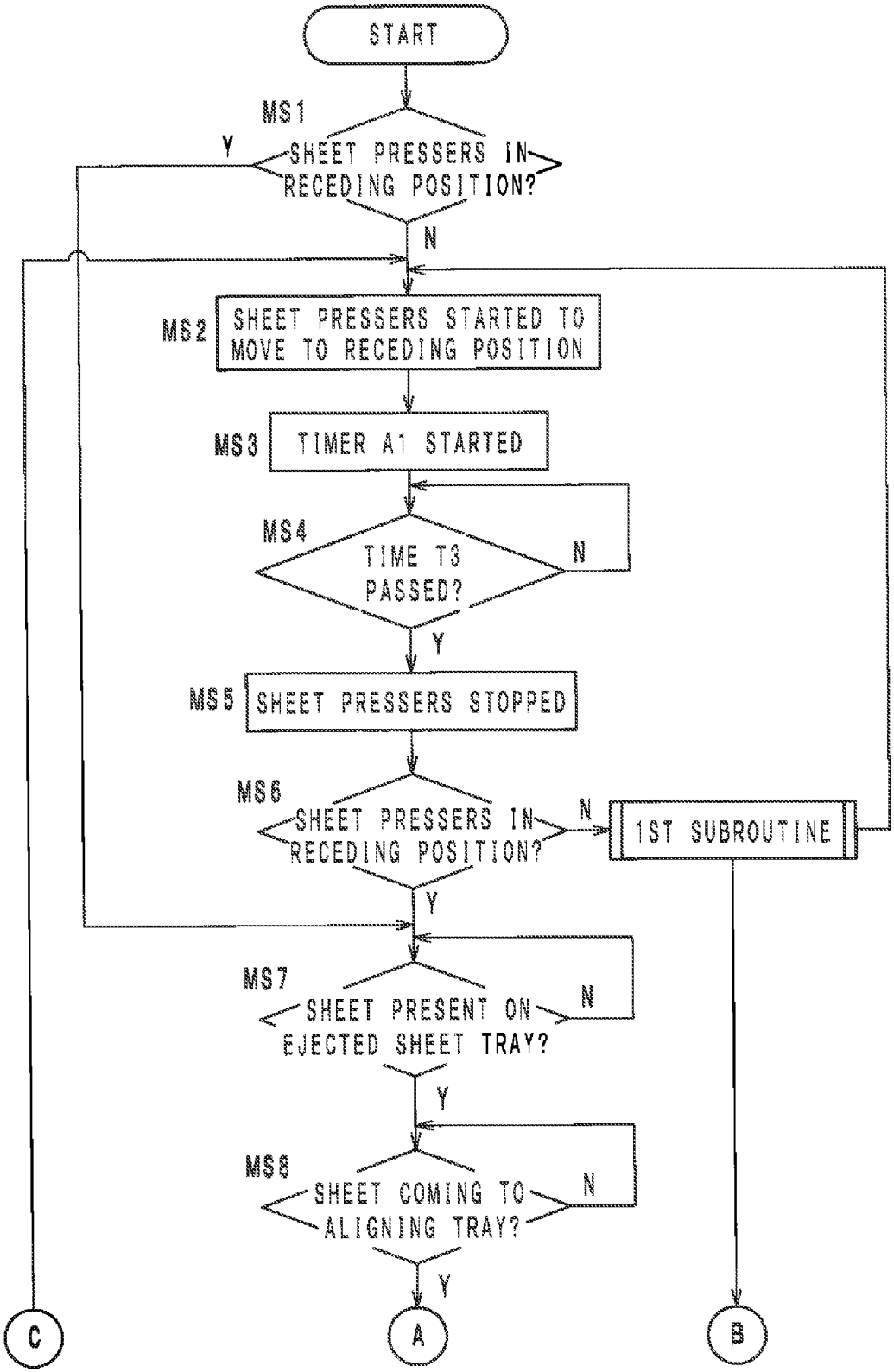
FIG. 13 is a flowchart indicating a procedure for controlling sheet ejection from the post-handling apparatus.
Figure 14:
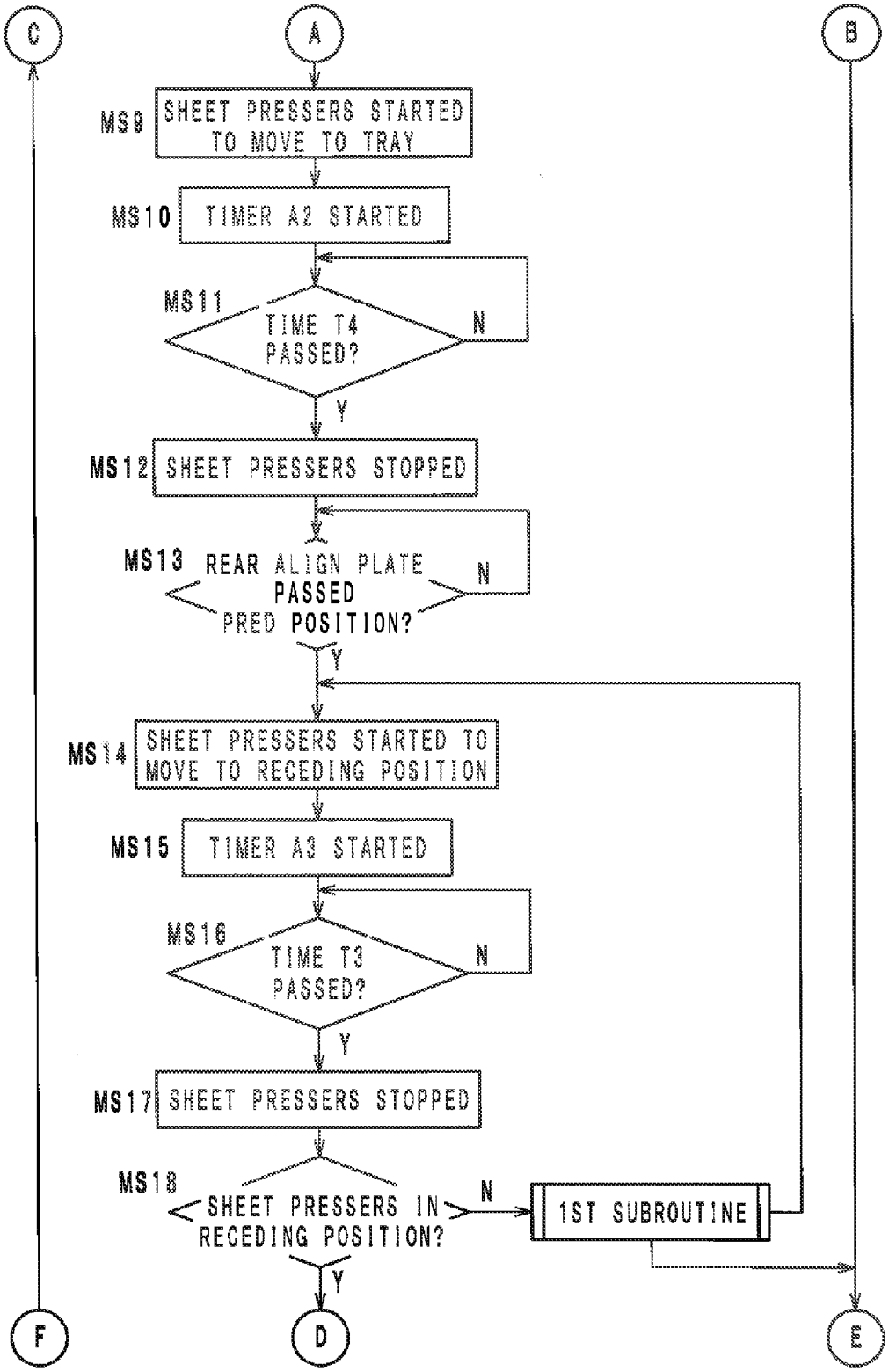
FIG. 14 is a flowchart indicating the procedure for controlling sheet ejection from the post-handling apparatus.
Figure 15:
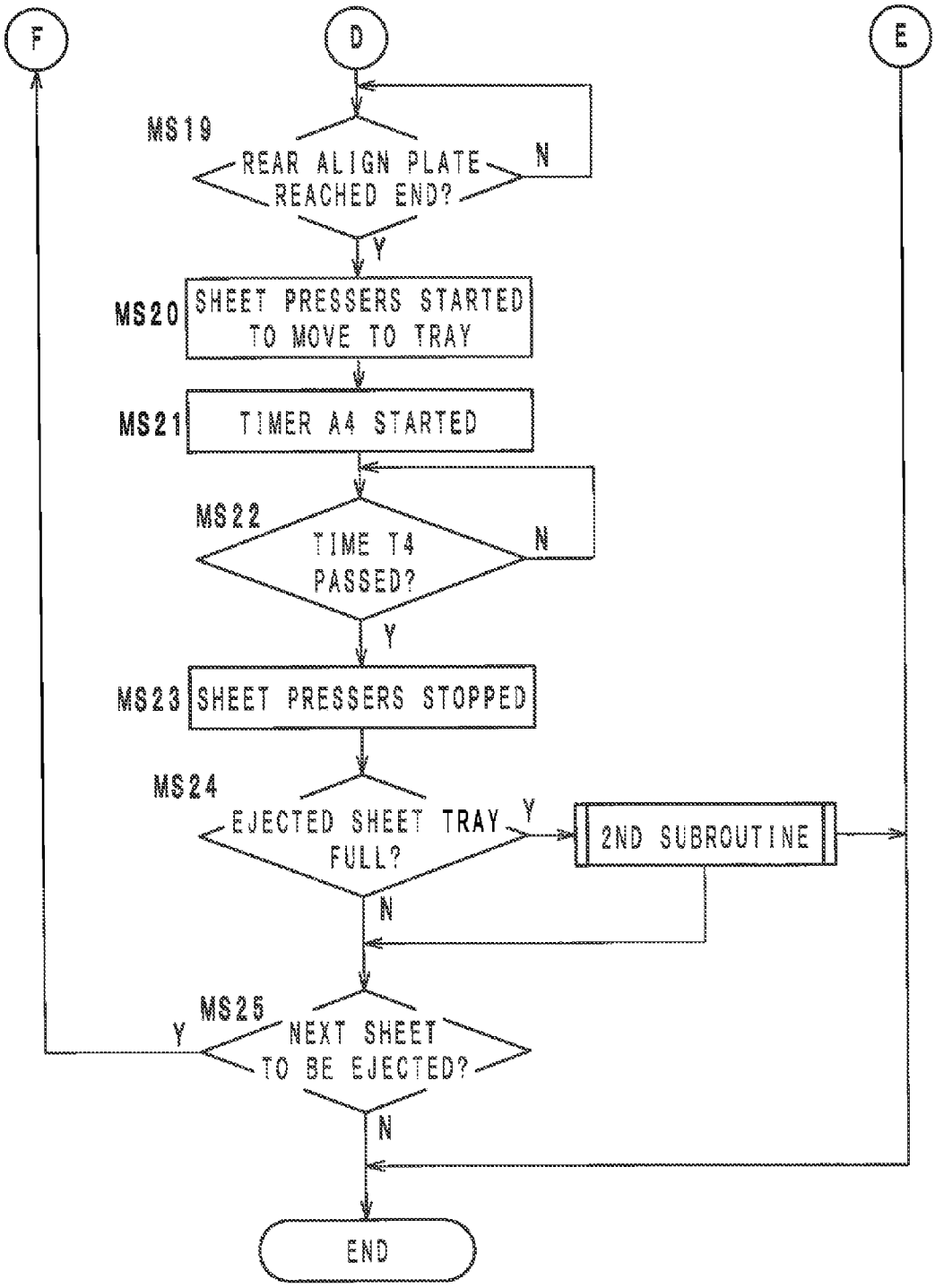
FIG. 15 is a flowchart indicating the procedure for controlling sheet ejection from the post-handling apparatus.

First, the main routine of the control procedure illustrated in FIGS. 13 through 15 is described. The main routine starts at a time of issuance of an image forming command from the control unit 4, that is, at a time of determination to eject a sheet from the image forming apparatus 2.

At step MS1 of the main routine, the control unit 4 determines the position of sheet pressers 39 from the signal sent from the monitoring system 47. If the control unit 4 determines that the sheet pressers 39 are not in the receding position (home position), the control procedure goes to step MS2, and if the control unit 4 determines that the sheet pressers 39 are in the receding position, the control procedure goes to step MS7.

At step MS2 of the main routine, the control unit 4 activates the motor 43 to start moving the sheet pressers 39 to the receding position.

At step MS3 of the main routine, the control unit 4 starts a timer A1. The timer A1 is to count down a predetermined time T3 from the time of starting a receding movement of the sheet pressers 39. The predetermined time T3, which is stored in the control unit 4, is a period of time required for a movement of the sheet pressers 39 from the ejected sheet tray 35 to the receding position plus a predetermined margin.

At step MS4 of the main routine, the control unit 4 determines whether the predetermined time T3 has passed. When the control unit 4 determines that the predetermined time T3 has passed, the control procedure goes to step MS5. The control procedure stands by at step MS4 until the predetermined time T3 has passed.

At step MS5 of the main routine, the control unit 4 stops the motor 43 to stop the receding movement of the sheet pressers 39.

At step MS6 of the main routine, the control unit 4 determines the position of the sheet pressers 39 from the signal sent from the monitoring system 47. If the control unit 4 determines that the sheet pressers 39 are in the receding position (home position), the control procedures goes to step MS7 of the main routine. If the control unit 4 determines that the sheet pressers 39 are not in the receding position, the control procedure goes to step FS1 of a first subroutine, which will be described later. In a case where the control procedure goes from step MS6 of the main routine to step FS1 of the first subroutine, the control procedure thereafter returns from the first subroutine to step MS2 of the main routine or ends.

At step MS7 of the main routine, the control unit 4 determines from the signal sent from the sheet ejection sensor 37 whether there are any sheets P2 on the ejected sheet tray 35. If the control unit 4 determines that there are no sheets P2 on the ejected sheet tray 35, the control procedure stands by at this step until the control unit 4 determines that there is a sheet P2 on the ejected sheet tray 35, that is, until a sheet has been ejected from the post-handling apparatus 3. When the control unit 4 determines that there are any sheets P2 on the ejected sheet tray 35, the control procedure goes to step MS8 of the main routine.

At step MS8 of the main routine, the control unit 4 determines from the signal sent from the sheet ejection sensor 60 located near the exit of the image forming apparatus 2 whether ejection of a sheet P1 from the image forming apparatus 2 onto the aligning tray 21 of the post-handling apparatus 3 has been started. When the control unit 4 determines that ejection of a sheet P1 from the image forming apparatus 2 onto the aligning tray 21 has been started, the control procedure goes to step MS9. The control procedure stands by at step MS8 until sheet ejection onto the aligning tray 21 is started.

At step MS9 of the main routine, the control unit 4 activates the motor 43 to start moving the sheet pressers 39 to the ejected sheet tray 35.

At step MS10 of the main routine, the control unit 4 starts a timer A2. The timer A2 is to count down a predetermined time T4 from the time of starting a movement of the sheet pressers 39 to the ejected sheet tray 35. The predetermined time T4, which is stored in the control unit 4, is a period of time required for a movement of the sheet pressers 39 from the receding position to the ejected sheet tray 35 plus a predetermined margin.

At step MS11 of the main routine, the control unit 4 determines whether the predetermined time T4 has passed. When the control unit 4 determines that the predetermined time T4 has passed, the control procedure goes to step MS12. The control procedure stands by at step MS11 until the predetermined time T4 has passed.

At step MS12 of the main routine, the control unit 4 stops the motor 43 to stop the movement of the sheet pressers 39 to the ejected sheet tray 35. At the same time, the rear-side aligning plate 29 starts moving toward the ejected sheet tray 35.

Figure 16:
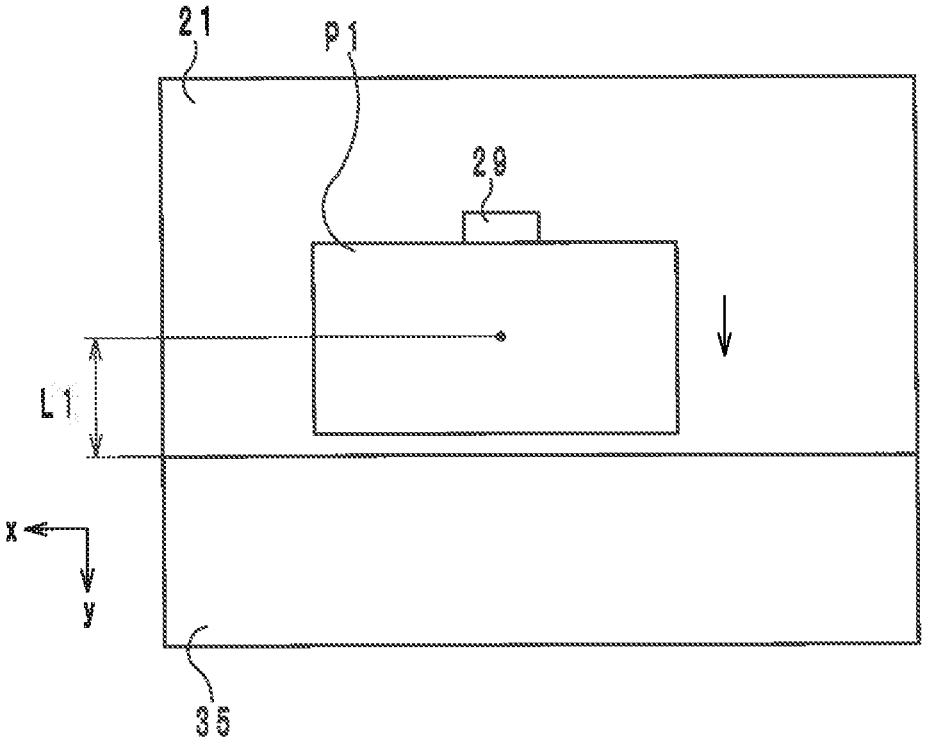
FIG. 16 is a schematic view from the vertical direction of the aligning tray, the ejected sheet tray and a rear-side aligning plate.

At step MS13 of the main routine, the control unit 4 determines whether the rear-side aligning plate 29 has passed a predetermined position on the aligning tray 21. As illustrated in FIG. 16, the predetermined position is a position at a distance L1 in the negative y-direction from the positive end in y-direction of the aligning tray 21, that is, from the exit of the post-handling apparatus 3. The distance L1 is obtained by $v \times \Delta t$, where v denotes the travel speed of the rear-side aligning plate 29, and $\Delta t$ denotes the period of time required for a movement of the sheet pressers 39 from the ejected sheet tray 35 to the receding position. When the control unit 4 determines that the rear-side aligning plate 29 has passed the predetermined position on the aligning tray 21, the control procedure goes to step MS14. The control procedure stands by at step MS13 until the rear-side aligning plate 29 has passed the predetermined position on the aligning tray 21.

At step MS14 of the main routine, the control unit 4 activates the motor 43 to start a movement of the sheet pressers 39 to the receding position. Therefore, when the trailing edge E2 of the sheet P1 being ejected from the aligning tray 21 falls down on the ejected sheet tray 35, the sheet pressers 39 have already receded from the ejected sheet tray 35, and there is no possibility that the sheet pressers 39 get stuck between the previously ejected sheet P2 and the newly ejected sheet P1.

At step MS15 of the main routine, the control unit 4 activates a timer A3. The timer A3 is to count down the predetermined time T3 from the time of starting a movement of the sheet pressers 39 to the receding position. As mentioned above, the predetermined time T3 is stored in the control unit 4 and is a period of time required for a movement of the sheet pressers 39 from the ejected sheet tray 35 to the receding position plus a predetermined margin.

At step MS16 of the main routine, the control unit 4 determines whether the predetermined time T3 has passed. When the control unit 4 determines that the predetermined time T3 has passed, the control procedure goes to step MS17. The control procedure stands by at step MS16 until the predetermined time T3 has passed.

At step MS17 of the main routine, the control unit 4 stops the motor 43 to stop the movement of the sheet pressers 39 to the receding position.

At step MS18 of the main routine, the control unit 4 determines the position of the sheet pressers 39 from the signal sent from the monitoring system 47. If the control unit 4 determines that the sheet pressers 39 are in the receding position (home position), the control procedure goes to step MS19 of the main routine. If the control unit 4 determines that the sheet pressers 39 are not in the receding position, the control procedure goes to step FS1 of the first subroutine, which will be described later. In a case where the control procedure goes from step MS18 of the main routine to step FS1 of the first subroutine, the control procedure thereafter returns from the first subroutine to step MS14 of the main routine or ends.

At step MS19 of the main routine, the control unit 4 determines whether the rear-side aligning plate 29 has reached the positive end in y-direction of the aligning tray 21, that is, whether the sheet P1 has been completely ejected from the aligning tray 21. When the control unit 4 determines that the rear-side aligning plate 29 has reached the positive end in y-direction of the aligning tray 21, the control procedure goes to step MS20. The control procedure stands by at step MS19 until the rear-side aligning plate 29 has reached the positive end in y-direction of the aligning tray 21. It is determined from the travel distance of the rear-side aligning plate 29 whether the rear-side aligning plate 29 has reached the positive end in y-direction of the aligning tray 21.

At step MS20 of the main routine, the control unit 4 activates the motor 43 to start a movement of the sheet pressers 39 to the ejected sheet tray 39.

At step MS21 of the main routine, the control unit 4 starts a timer A4. The timer A4 is to count down the predetermined time T4 from the time of starting a movement of the sheet pressers 39 to the ejected sheet tray 35. As mentioned above, the predetermined time T4 is stored in the control unit 4 and is a period of time required for a movement of the sheet pressers 39 from the receding position to the ejected sheet tray 35 plus a predetermined margin.

At step MS22 of the main routine, the control unit 4 determines whether the predetermined time T4 has passed. When the control unit 4 determines that the predetermined time T4 has passed, the control procedure goes to step MS23. The control procedure stands by at step MS22 until the predetermined time T4 has passed.

At step MS23 of the main routine, the control unit 4 stops the motor 43 to stop the movement of the sheet pressers 39 to the ejected sheet tray 35.

At step MS24 of the main routine, the control unit 4 determines whether sheets have been stacked on the ejected sheet tray 35 up to the limit of loading capacity. If the control unit 4 determines that sheets have been stacked on the ejected sheet tray 35 up to the limit of loading capacity, the control procedure goes to step SS1 of a second subroutine, which will be described later. If the control unit 4 determines that sheets have not been stacked on the ejected sheet tray 35 up to the limit of loading capacity, the control procedure goes to step MS25.

At step MS25 of the main routine, the control unit 4 determines whether a next sheet is to be ejected from the image forming apparatus 2. If there is a next sheet to be ejected from the image forming apparatus 2, the control procedure returns to step MS2. If there is no sheet to be ejected from the image forming apparatus 2, the control procedure ends.

First Subroutine

Figure 17:
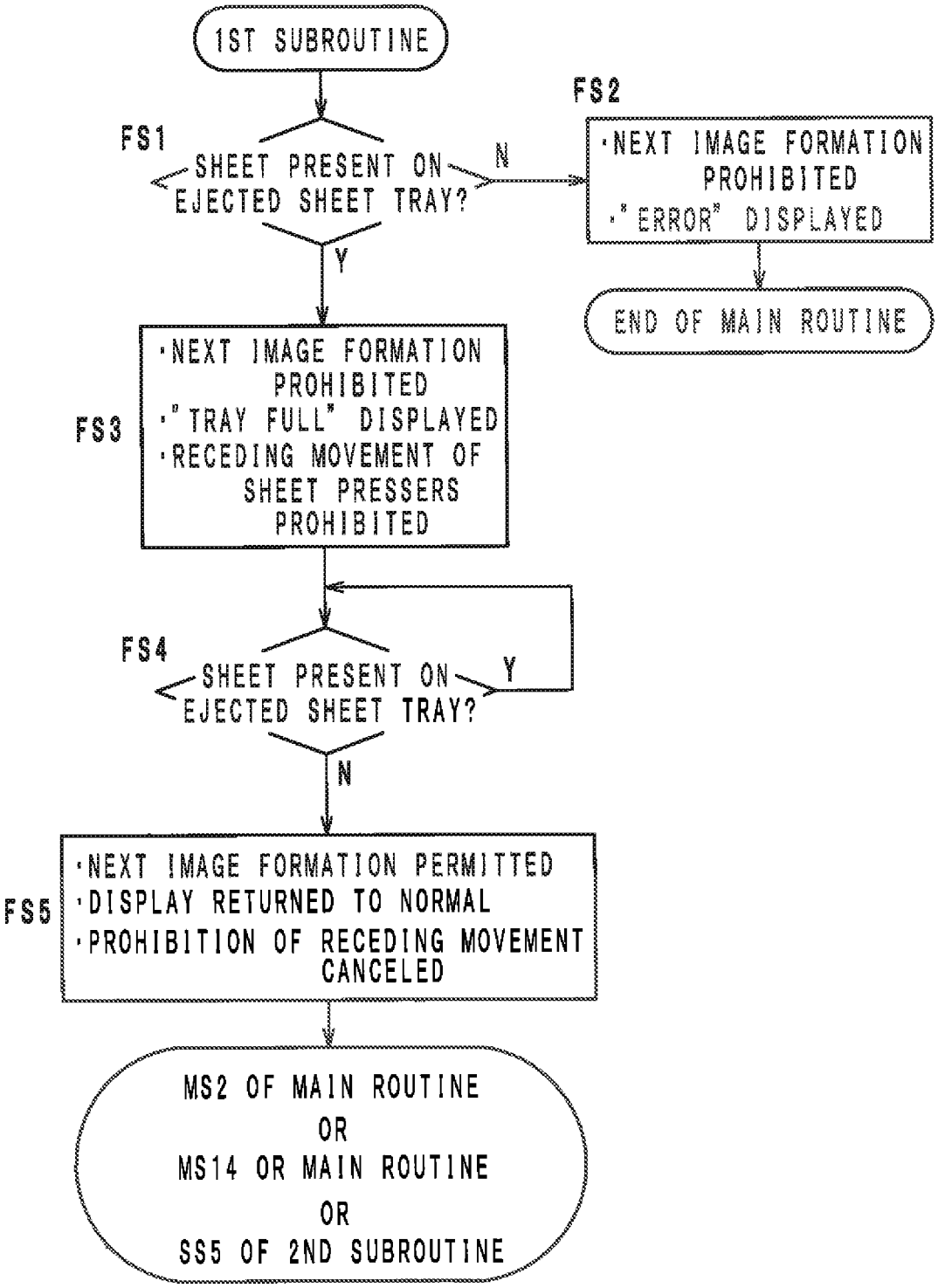
FIG. 17 is a flowchart indicating the procedure for controlling sheet ejection from the post-handling apparatus.

The first subroutine illustrated in FIG. 17 is a routine that is selected in a case where a movement of the sheet pressers 39 to the receding position by order of the control unit 4 is not completed within a predetermined period of time.

At step FS1 of the first subroutine, the control unit 4 determines from a signal sent from the sheet ejection sensor 37 whether there are any sheets P2 on the ejected sheet tray 35. If the control unit 4 determines that there are no sheets P2 on the ejected sheet tray 35, the control procedure goes to step FS2. If the control unit determines that there are any sheets P2 on the ejected sheet tray 35, the control procedure goes to step FS3.

At step FS2 of the first subroutine, the control unit 4 stops the image forming apparatus 2 from starting a next image forming process. Also, the control unit 4 drives the interface IF provided on the image forming apparatus 2 to display information that a component relating to the sheet pressers 39 has a defect. Thereafter, the control procedure ends.

At step FS3 of the first subroutine, the control unit 4 stops the image forming apparatus 2 from starting a next image forming process. Also, the control unit 4 drives the interface IF provided on the image forming apparatus 2 to display information that sheets have been stacked on the ejected sheet tray 35 up to the limit of loading capacity, that is, display information that the ejected sheet tray 35 is full. Further, the control unit 4 prohibits the sheet pressers 39 from moving to the receding position.

At step FS4 of the first subroutine, the control unit 4 determines from the signal sent from the sheet ejection sensor 37 whether there are any sheets P2 on the ejected sheet tray 35. If the control unit 4 determines that there are any sheets P2 on the ejected sheet tray 35, the control procedure stands by at this step until the control unit 4 determines that there are no sheets P2 on the ejected sheet tray 35, that is, until a user removes the sheets P2 from the ejected sheet tray 35. When the control unit 4 determines that there are no sheets P2 on the ejected sheet tray 35, the control procedure goes to step FS5.

At step FS5 of the first subroutine, the control unit 4 permits the image forming apparatus 2 to start a next image forming process. Also, the control unit 4 returns the display screen of the interface IF provided on the image forming apparatus 2 to a normal screen. Further, the control unit 4 cancels the prohibition of a receding movement of the sheet pressers. Thereafter, the control procedure returns to step MS2 or step MS14 of the main routine or returns to step SS5 of the second subroutine, which will be described below.

Second Subroutine

Figure 18:
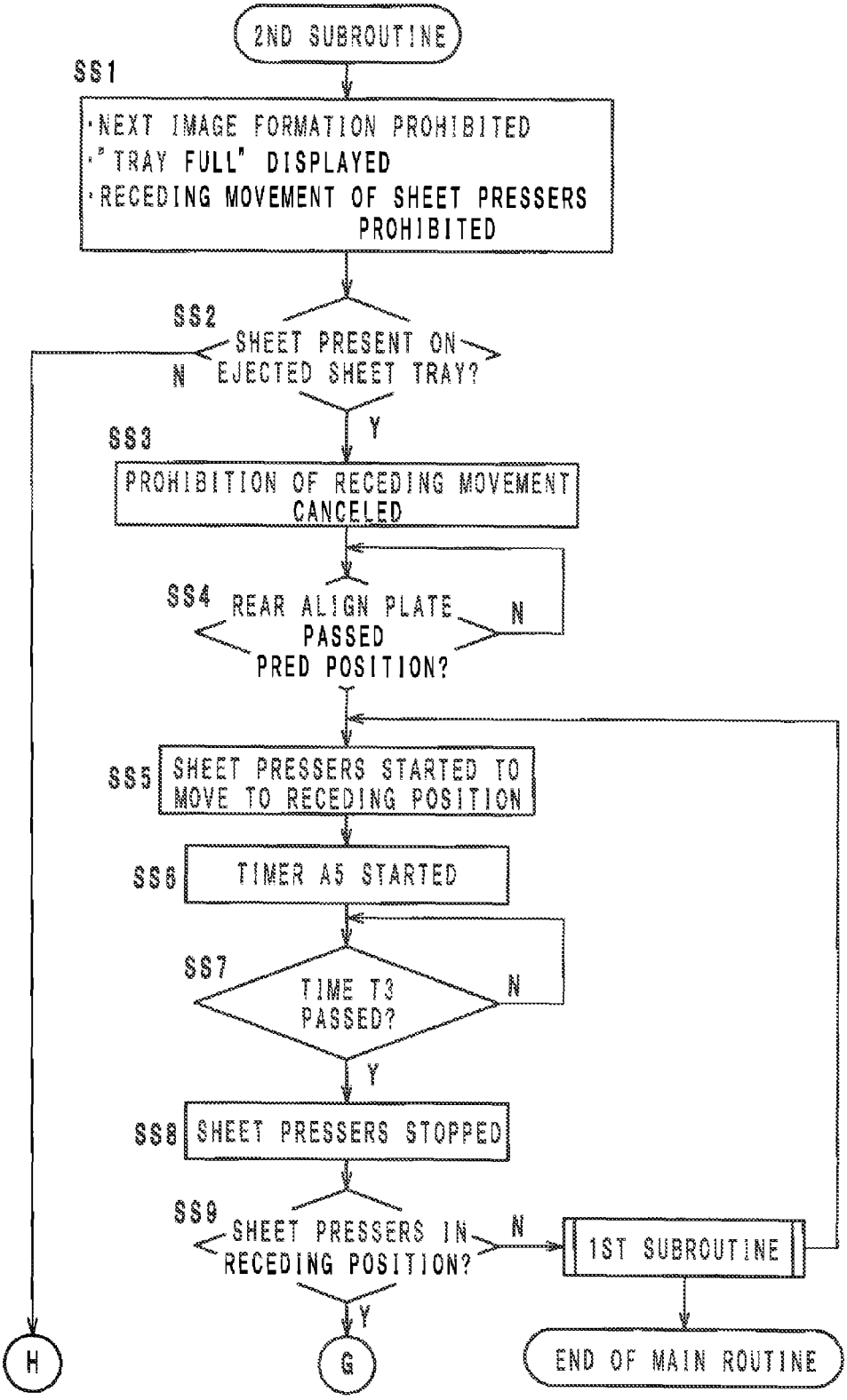
FIG. 18 is a flowchart indicating the procedure for controlling sheet ejection from the post-handling apparatus.
Figure 19:
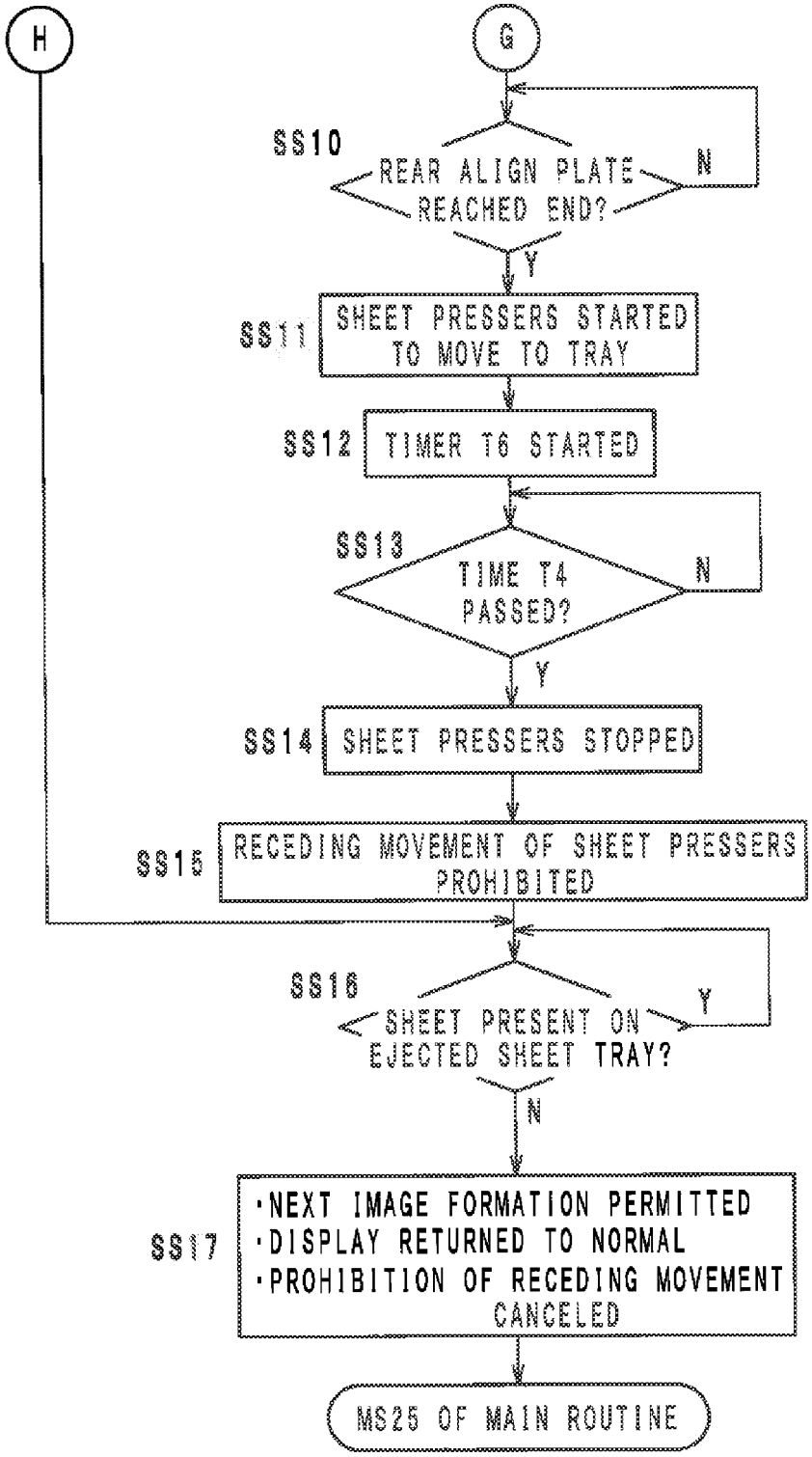
FIG. 19 is a flowchart indicating the procedure for controlling sheet ejection from the post-handling apparatus.

The second subroutine illustrated in FIGS. 18 and 19 is a routine that is selected in a case where the control unit 4 determines that sheets have been stacked on the ejected sheet tray 35 up to the limit of loading capacity.

At step SS1 of the second subroutine, the control unit 4 stops the image forming apparatus 2 from starting a next image forming process. Also, the control unit 4 drives the interface IF to display information that sheets have been stacked on the ejected sheet tray 35 up to the limit of loading capacity. Further, the control unit 4 prohibits the sheet pressers 39 from moving to the receding position.

At step SS2 of the second subroutine, the control unit 4 determines from signals sent from sensors and other devices provided around the aligning tray 21 whether there is a sheet P1 on the aligning tray 21. If the control unit 4 determines that there is a sheet P1 on the aligning tray 21, the control procedure goes to step SS3. If the control unit 4 determines that there are no sheets P1 on the aligning tray 21, the control procedure goes to step SS16.

At step SS3, the control unit 4 cancels the prohibition of a receding movement of the sheet pressers 39. Substantially at the same time as the cancellation of the prohibition of a receding movement of the sheet pressers 39, the control unit 4 drives the rear-side aligning plate 29 of the aligning tray 21 to move toward the ejected sheet tray 35. Thereby, the sheet P1 on the aligning tray 21 is moved from the aligning tray 21 toward the ejected sheet tray P1.

At step SS4 of the second subroutine, the control unit 4 determines whether the rear-side aligning plate 29 has passed the predetermined position on the aligning tray 21. As mentioned above, the predetermined position is a position at a distance L1 in the negative y-direction from the positive end in y-direction of the aligning tray 21, that is, from the exit of the post-handling apparatus 3. When the control unit 4 determines that the rear-side aligning plate 29 of the aligning tray 21 has passed the predetermined position, the control procedure goes to step SS5. The control procedure stands by at step SS4 until the rear-side aligning plate 29 of the aligning tray 21 has passed the predetermined position.

At step SS5 of the second subroutine, the control unit 4 activates the motor 43 to start a movement of the sheet pressers 39 to the receding position. Accordingly, when the trailing edge E2 of the sheet P1 falls down on the ejected sheet tray 35, the sheet pressers 39 has receded from the ejected sheet tray 35 into the receding position, and there is no possibility that the sheet pressers 39 are stuck between the previously ejected sheet P2 and the sheet P1 newly coming to the ejected sheet tray 35.

At step SS6 of the second subroutine, the control unit 4 starts a timer A5. The timer A5 is to count down the predetermined time T3 from the start of a movement of the sheet pressers 39 toward the receding position. As mentioned above, the predetermined time T3 is stored in the control unit 4 and is a period of time required for a movement of the sheet pressers 39 from the ejected sheet tray 35 to the receding position plus a predetermined margin.

At step SS7 of the second subroutine, the control unit 4 determines whether the predetermined time T3 has passed. When the control unit 4 determines that the predetermined time T3 has passed, the control procedure goes to step SS8. The control procedure stands by at step SS7 until the predetermined time T3 has passed.

At step SS9 of the second subroutine, the control unit 4 determines the position of the sheet pressers 39 from the signal sent from the monitoring system 47. If the control unit 4 determines that the sheet pressers 39 are in the receding position (home position), the control procedure goes to step SS10 of the second subroutine. If the control unit 4 determines that the sheet pressers 39 are not in the receding position, the control procedure goes to step FS1 of the first subroutine. In a case where the control procedure goes from the step SS9 of the second subroutine to the first subroutine, the control procedure thereafter returns from the first subroutine to the second subroutine or ends.

At step SS10 of the second subroutine, the control unit 4 determines whether the rear-side aligning plate 29 has reached the positive end in y-direction of the aligning tray 21, that is, whether the sheet P1 has been completely ejected from the aligning tray 21. When the control unit 4 determines that the rear-side aligning plate 29 has reached the positive end in y-direction of the aligning tray 21, the control procedure goes to step SS11. The control procedure stands by at step SS10 until the rear-side aligning plate 29 has reached the positive end in y-direction of the aligning tray 21.

At step SS11 of the second subroutine, the control unit 4 activates the motor 43 to start a movement of the sheet pressers 39 toward the ejected sheet tray 35.

At step SS12 of the second subroutine, the control unit 4 starts a timer A6. The timer A6 is to count down the predetermined time T4 from the time of starting a movement of the sheet pressers 39 toward the ejected sheet tray 35. As mentioned above, the predetermined time T4 is stored in the control unit 4 and is a period of time required for a movement of the sheet pressers 39 from the receding position to the ejected sheet tray 35 plus a predetermined margin.

At step SS13 of the second subroutine, the control unit 4 determines whether the time T4 has passed. When the control unit 4 determines that the time T4 has passed, the control procedure goes to step SS14. The control procedure stands by at step SS13 until the time T4 has passed.

At step SS14 of the second subroutine, the control unit 4 stops the motor 43 to stop the movement of the sheet pressers 39 toward the ejected sheet tray 35.

At step SS15 of the second subroutine, the control unit 4 prohibits the sheet pressers 39 from receding.

At step SS16 of the second subroutine, the control unit 4 determines from the signal sent from the sheet ejection sensor 37 whether there are any sheets P2 on the ejected sheet tray 35. If the control unit 4 determines that there are any sheets P2 on the ejected sheet tray 35, the control procedure stands by at this step until the control unit 4 determines that there are no sheets P2 on the ejected sheet tray 35, that is, until a user has removed the sheets P2 from the ejected sheet tray 35. When the control unit 4 determines that there are no sheets P2 on the ejected sheet tray 35, the control procedure goes to step SS17.

At step SS17 of the second subroutine, the control unit 4 permits the image forming apparatus 2 to start a next image forming process. Also, the control unit 4 returns the display screen of the interface IF to a normal screen. Further, the control unit 4 cancels the prohibition of a receding movement of the sheet pressers 39. Thereafter, the control procedure goes to step MS25 of the main routine.

Advantageous Effects

In the image forming system 1 and in the post-handling apparatus 3, when the leading edge E1 of a sheet P1 or a stack of sheets P1 newly coming to the ejected sheet tray 35 falls down on the ejected sheet tray 35, the sheet pressers 39 press the sheets P2 previously ejected onto the ejected sheet tray 35. Thereby, in the image forming system 1 and in the post-handling apparatus 3, it is possible to prevent the sheets P2 previously ejected onto the ejected sheet tray 35 from falling from the ejected sheet tray 35 due to collision with the sheet or the stack of sheets P1 newly coming to the ejected sheet tray 35. Also, it is possible to prevent the sheets P2 previously ejected onto the ejected sheet tray 35 from becoming out of alignment due to collision with the sheet or the stack of sheets P1 newly coming onto the ejected sheet tray 35.

In the image forming system 1 and in the post-handling apparatus 3, further, since the sheet pressers 39 press the sheets P2 ejected onto the ejected sheet tray 35, it is possible to prevent the sheets P2 from curling, thereby preventing the sheets P2 from increasing in volume on the ejected sheet tray 35.

Moreover, in the image forming system 1 and in the post-handling apparatus 3, when the trailing edge E2 of the sheet or the stack of sheets P1 falls down on the ejected sheet tray 35, the sheet pressers 39 have already receded from the sheet ejected tray 35, and therefore, there is no possibility that the sheet pressers 39 are stuck between the sheets P2 previously ejected onto the ejected sheet tray 35 and the sheet or the stack of sheets P1 newly coming onto the ejected sheet tray 35.

In the image forming system 1 and in the post-handling apparatus 3, the amount of sheets P2 loaded on the ejected sheet tray 35 is derived from the travel distance of the sheet pressers 39 from the receding position to the upper surface of the sheets P2 on the ejected sheet tray 35. Therefore, it is not necessary to provide the image forming system 1 or the post-handling apparatus 3 with an additional system configured to figure out the amount of sheets P2 loaded on the ejected sheet tray 35. Thus, in the image forming system 1 and the post-handling apparatus 3, figuring out the amount of sheets P2 loaded on the ejected sheet tray 35 based on the movement of the sheet pressers 39 results in space saving and a reduction in cost.

As illustrated in FIG. 11, if the sheet or the stack of sheets P1 is stuck between the exit of the post-handling apparatus 3 and the sheet pressers 39, the movement of the sheet pressers 39 cannot be completed. In order to address this trouble, if a movement of the sheet pressers 39 to the receding position by order of the control unit 4 is not completed within the predetermined time and if there are any sheets P2 on the ejected sheet tray 35, the control unit 4 drives the interface IF provided on the image forming apparatus 2 to display information that sheets have been stacked on the ejected sheet tray 35 up to the limit of loading capacity. By the display, the user can possibly perceive that a sheet or a stack of sheets P1 is stuck between the exit of the post-handling apparatus 3 and the sheet pressers 39 and remove the sheet or the stack of sheets P1 therefrom.

In a case where a movement of the sheet pressers 39 to the receding position by order of the control unit 4 is not completed within the predetermined time, the control unit 4 takes different procedures depending on whether there are any sheets on the ejected sheet tray 35. This control contributes to a decrease in the frequency of calling a serviceman of a maintenance agency for maintenance of the image forming apparatus 2 and the post-handling apparatus 3 or the image forming system 1, compared to a case of adopting a control procedure in which the control unit 4 drives the interface IF to display information that a component relating to the sheet pressers 39 has a defect regardless of whether there are any sheets on the ejected sheet tray 35.

Modification

An image forming system 1A and a post-handling apparatus 3A according to a modification are different from the image forming system 1 and the post-handling apparatus 3 according to the above-described embodiment in the condition of starting the control procedure for sheet ejection from the post-handling apparatus. According to the modification, the control procedure is started on the condition that the post-handling apparatus 3A or the image forming system 1A is started.

By setting a start of the post-handling apparatus 3A or the image forming system 1A as the condition for a start of the control procedure, the sheet pressers 39 can be returned to the receding position (home position) before the control unit 4 issues an image forming command. Therefore, at a time of issuance of an image forming command, the main routine starts from step MS7, and a series of actions from image formation to sheet ejection from the post-handling apparatus 3 can be performed more smoothly.

Other Embodiments

Post-handling apparatuses and image forming systems according to the present invention are not limited to the embodiment and the modification described above. For example, the control unit 4 may be provided not in the image forming apparatus 2 but in the post-handling apparatus 3.

Although the present invention has been described in connection with the embodiment and the modification above, it is to be noted that various changes and modifications may be obvious to those who are skilled in the art. Such changes and modifications are to be understood as being within the scope of the invention.

What is claimed is:

1. A post-handling apparatus for handling sheets ejected from an image forming apparatus, the post-handling apparatus comprising:

an aligning tray configured to receive a sheet from the image forming apparatus;

an ejected sheet tray located adjacent to the aligning tray;

a conveyer configured to convey the sheet on the aligning tray to the ejected sheet tray in a sheet ejecting direction;

a sheet presser configured to press a sheet previously ejected onto the ejected sheet tray against the ejected sheet tray; and a control unit configured to process information in the post-handling apparatus, and to control operation, wherein:

the sheet presser presses the sheet previously ejected onto the ejected sheet tray when a leading edge, with respect to the sheet ejecting direction, of a sheet currently conveyed to the ejected sheet tray falls down on the ejected sheet tray, and is in a receding position receding from the ejected sheet tray when a trailing edge, with respect to the sheet ejecting direction, of the sheet currently conveyed to the ejected sheet tray falls down on the ejected sheet tray;

after completion of ejection of a sheet onto the ejected sheet tray, the control unit drives the sheet presser to move from the receding position to an upper surface of the sheet ejected onto the ejected sheet tray, reads a travel distance of the sheet presser, and determines from the travel distance of the sheet presser whether sheets have been stacked on the ejected sheet tray up to a limit of loading capacity of the ejected sheet tray; and in a case in which the control unit determines that sheets have been stacked on the ejected sheet tray up to the limit of loading capacity of the ejected sheet tray, the control unit prohibits the sheet presser from receding from the ejected sheet tray.

2. The post-handling apparatus according to claim 1, wherein in the case in which the control unit determines that sheets have been stacked on the ejected sheet tray up to the limit of loading capacity of the ejected sheet tray, the control unit prohibits the image forming apparatus from starting a next image forming process.

3. The post-handling apparatus according to claim 1, wherein a movement of the sheet presser to press the sheet against the ejected sheet tray is started in a case in which there is a sheet on the ejected sheet tray and when ejection of a sheet from the image forming apparatus to the aligning tray is started.

4. The post-handling apparatus according to claim 1, wherein a movement of the sheet presser to recede from the ejected sheet tray is started earlier than a point of time when the trailing edge, with respect to the sheet ejecting direction, of the sheet currently conveyed to the ejected sheet tray reaches an end of the aligning tray bordering the ejected sheet tray by a period of time required for a movement of the sheet presser from the ejected sheet tray to the receding position.

5. The post-handling apparatus according to claim 1, wherein, at a time of starting the post-handling apparatus, the control unit drives the sheet presser to move from the receding position to an upper surface of a sheet previously ejected onto the ejected sheet tray, reads a travel distance of the sheet presser, and determines from the travel distance of the sheet presser whether sheets have been stacked on the ejected sheet tray up to the limit of loading capacity of the ejected sheet tray.

6. The post-handling apparatus according to claim 1, wherein, after the control unit determines that sheets have been stacked on the ejected sheet tray up to the limit of loading capacity of the ejected sheet tray, in a case in which there are no sheets on the aligning tray and in which the sheet presser is not in the receding position, the control unit cancels the prohibition of a movement of the sheet presser from the ejected sheet tray.

7. The post-handling apparatus according to claim 2, wherein, after the control unit determines that sheets have been stacked on the ejected sheet tray up to the limit of loading capacity of the ejected sheet tray, in a case in which there are no sheets on the aligning tray and in which the sheet presser is not in the receding position, the control unit cancels the prohibition of a next image forming process by the image forming apparatus.

8. The post-handling apparatus according to claim 2, wherein the sheet conveyed from the aligning tray to the ejected sheet tray passes over an upper side of the sheet presser.

9. A post-handling apparatus for handling sheets ejected from an image forming apparatus, the post-handling apparatus comprising:

an aligning tray configured to receive a sheet from the image forming apparatus;

an ejected sheet tray located adjacent to the aligning tray;

a conveyer configured to convey the sheet on the aligning tray to the ejected sheet tray in a sheet ejecting direction;

a sheet presser configured to press a sheet previously ejected onto the ejected sheet tray against the ejected sheet tray; and a control unit configured to process information in the post-handling apparatus, and to control operation, wherein:

the sheet presser presses the sheet previously ejected onto the ejected sheet tray when a leading edge, with respect to the sheet ejecting direction, of a sheet currently conveyed to the ejected sheet tray falls down on the ejected sheet tray, and is in a receding position receding from the ejected sheet tray when a trailing edge, with respect to the sheet ejecting direction, of the sheet currently conveyed to the ejected sheet tray falls down on the ejected sheet tray;

after completion of ejection of a sheet onto the ejected sheet tray, the control unit drives the sheet presser to move from the receding position to an upper surface of the sheet ejected onto the ejected sheet tray, reads a travel distance of the sheet presser, and determines from the travel distance of the sheet presser whether sheets have been stacked on the ejected sheet tray up to a limit of loading capacity of the ejected sheet tray; and in a case in which a movement of the sheet presser from the ejected sheet tray to the receding position by order of the control unit is not completed within a predetermined period of time and in which there is a sheet on the ejected sheet tray, the control unit determines that sheets have been stacked on the ejected sheet tray up to the limit of loading capacity of the ejected sheet tray.

10. The post-handling apparatus according to claim 9, wherein in a case in which the control unit determines that sheets have been stacked on the ejected sheet tray up to the limit of loading capacity of the ejected sheet tray, the control unit prohibits the sheet presser from receding from the ejected sheet tray.

11. The post-handling apparatus according to claim 9, wherein in a case in which the control unit determines that sheets have been stacked on the ejected sheet tray up to the limit of loading capacity of the ejected sheet tray, the control unit prohibits the image forming apparatus from starting a next image forming process.

12. The post-handling apparatus according to claim 9, wherein a movement of the sheet presser to press the sheet against the ejected sheet tray is started in a case in which there is a sheet on the ejected sheet tray and when ejection of a sheet from the image forming apparatus to the aligning tray is started.

13. The post-handling apparatus according to claim 9, wherein a movement of the sheet presser to recede from the ejected sheet tray is started earlier than a point of time when the trailing edge, with respect to the sheet ejecting direction, of the sheet currently conveyed to the ejected sheet tray reaches an end of the aligning tray bordering the ejected sheet tray by a period of time required for a movement of the sheet presser from the ejected sheet tray to the receding position.

14. The post-handling apparatus according to claim 9, wherein, at a time of starting the post-handling apparatus, the control unit drives the sheet presser to move from the receding position to an upper surface of a sheet previously ejected onto the ejected sheet tray, reads a travel distance of the sheet presser, and determines from the travel distance of the sheet presser whether sheets have been stacked on the ejected sheet tray up to the limit of loading capacity of the ejected sheet tray.

15. A post-handling apparatus for handling sheets ejected from an image forming apparatus, the post-handling apparatus comprising:

an aligning tray configured to receive a sheet from the image forming apparatus;

an ejected sheet tray located adjacent to the aligning tray;

a conveyer configured to convey the sheet on the aligning tray to the ejected sheet tray in a sheet ejecting direction;

a sheet presser configured to press a sheet previously ejected onto the ejected sheet tray against the ejected sheet tray; and a control unit configured to process information in the post-handling apparatus, and to control operation, wherein:

the sheet presser presses the sheet previously ejected onto the ejected sheet tray when a leading edge, with respect to the sheet ejecting direction, of a sheet currently conveyed to the ejected sheet tray falls down on the ejected sheet tray, and is in a receding position receding from the ejected sheet tray when a trailing edge, with respect to the sheet ejecting direction, of the sheet currently conveyed to the ejected sheet tray falls down on the ejected sheet tray;

after completion of ejection of a sheet onto the ejected sheet tray, the control unit drives the sheet presser to move from the receding position to an upper surface of the sheet ejected onto the ejected sheet tray, reads a travel distance of the sheet presser, and determines from the travel distance of the sheet presser whether sheets have been stacked on the ejected sheet tray up to a limit of loading capacity of the ejected sheet tray; and in a case in which a movement of the sheet presser from the ejected sheet tray to the receding position by order of the control unit is not completed within a predetermined period of time and in which there are no sheets on the ejected sheet tray, the control unit determines that a component relating to the sheet presser has a defect.

16. The post-handling apparatus according to claim 15, wherein in a case in which the control unit determines that sheets have been stacked on the ejected sheet tray up to the limit of loading capacity of the ejected sheet tray, the control unit prohibits the sheet presser from receding from the ejected sheet tray.

17. The post-handling apparatus according to claim 15, wherein in a case in which the control unit determines that sheets have been stacked on the ejected sheet tray up to the limit of loading capacity of the ejected sheet tray, the control unit prohibits the image forming apparatus from starting a next image forming process.

18. The post-handling apparatus according to claim 15, wherein a movement of the sheet presser to press the sheet against the ejected sheet tray is started in a case in which there is a sheet on the ejected sheet tray and when ejection of a sheet from the image forming apparatus to the aligning tray is started.

19. The post-handling apparatus according to claim 15, wherein a movement of the sheet presser to recede from the ejected sheet tray is started earlier than a point of time when the trailing edge, with respect to the sheet ejecting direction, of the sheet currently conveyed to the ejected sheet tray reaches an end of the aligning tray bordering the ejected sheet tray by a period of time required for a movement of the sheet presser from the ejected sheet tray to the receding position.

20. The post-handling apparatus according to claim 15, wherein, at a time of starting the post-handling apparatus, the control unit drives the sheet presser to move from the receding position to an upper surface of a sheet previously ejected onto the ejected sheet tray, reads a travel distance of the sheet presser, and determines from the travel distance of the sheet presser whether sheets have been stacked on the ejected sheet tray up to the limit of loading capacity of the ejected sheet tray.

* * * * *